US006398574B1

(12) United States Patent
Biermann et al.

(10) Patent No.: US 6,398,574 B1
(45) Date of Patent: Jun. 4, 2002

(54) SLEEVE AND STUD CONNECTOR LATCH

(75) Inventors: Werner Biermann, Winterbach; Robert Hasenfratz, Waiblingen, both of (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/664,935

(22) Filed: Sep. 19, 2000

(30) Foreign Application Priority Data

Sep. 24, 1999 (DE) ..... 199 45 784

(51) Int. Cl.[7] ..... H01R 13/627

(52) U.S. Cl. ..... 439/350; 439/351; 439/842; 439/843

(58) Field of Search ..... 439/350, 351, 439/352, 353, 354, 355, 356, 357, 851, 852, 842, 843

(56) References Cited

U.S. PATENT DOCUMENTS 3,471,824 A * 10/1969 Greulich et al. ..... 439/282
4,840,587 A * 6/1989 Lancella ..... 439/851
4,906,211 A * 3/1990 Bell et al. ..... 439/851
5,533,914 A * 7/1996 Sawada ..... 439/843

FOREIGN PATENT DOCUMENTS

DE 2 143 434 8/1971

* cited by examiner

*Primary Examiner*—P. Austin Bradley
*Assistant Examiner*—Alexander Gilman
(74) *Attorney, Agent, or Firm*—Roger C. Turner

(57) ABSTRACT

A pair of mated connector (11, 12) are latched together by a pair of studs (21) on a first connector that are inserted into a pair of sleeve assemblies (22) on the second connector, with each stud having a stud groove (40) that receives an inwardly projecting flange (32) of the sleeve assembly. The sleeve assembly includes an outer sleeve (54) with an internal sleeve groove (28), and a spring clip (23) lying in the sleeve groove. The spring clip is largely in the form of a cylinder with an axially-extending slot (31) that allows the cylinder to resiliently expand and contract. The spring clip is trapped in the sleeve groove and has an inwardly-projecting flange (32) that snaps into the stud groove when the stud is fully inserted.

5 Claims, 3 Drawing Sheets

SLEEVE AND STUD CONNECTOR LATCH

BACKGROUND OF THE INVENTION

One mechanism for locking together a pair of mated connectors, includes a U-shaped spring wire that can slide in openings at opposite sides of a sleeve. When a stud on the mating connector is inserted into the sleeve, the spring wire is slid down into the grooves of the studs. This approach has the disadvantage that during assembly of a connector, it is difficult to fit the spring wire into the holes in the sleeve. Also, the reliability of locking is compromised because locking is effected only at two diametrically opposite locations. An apparatus for latching a stud of one connector in a sleeve of another connector, which was easy to install even in very small connectors and which could provide latching engagement along a majority of the circumference of the stud, would be of value.

SUMMARY OF THE INVENTION

In accordance with one embodiment of the present invention, an apparatus is provided for latching a stud of one connector in a sleeve of a mating connector, which is easy to install, provides a latching surface that can extend around at least one third of a circle, provides automatic latching, and can provide simple unlatching by firmly pulling the connectors apart. The sleeve assembly that receives the stud includes an outer sleeve with an internal circumferential sleeve groove and a largely cylindrical spring clip that is trapped in the groove. The spring clip has an axial slot that allows the clip to expand and contract. The clip also has a radially inwardly-extending projection forming an internal flange. When the stud with a groove in it is inserted so the stud groove approaches the middle of the clip, the flange on the clip snaps into the stud groove to lock the stud in place. The internal flange of the spring clip has tapered front and rear surfaces, so the stud can be inserted by pushing it firmly into the sleeve and can be removed by firmly pulling it out of the sleeve.

The required insertion and pullout force can be determined, in part, by the angles of the front and rear ends of the clip inward projection. In most cases, about the same force can be used for insertion and removal, and the spring clip can be symmetric so it can be installed without paying attention as to which end is inserted first.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
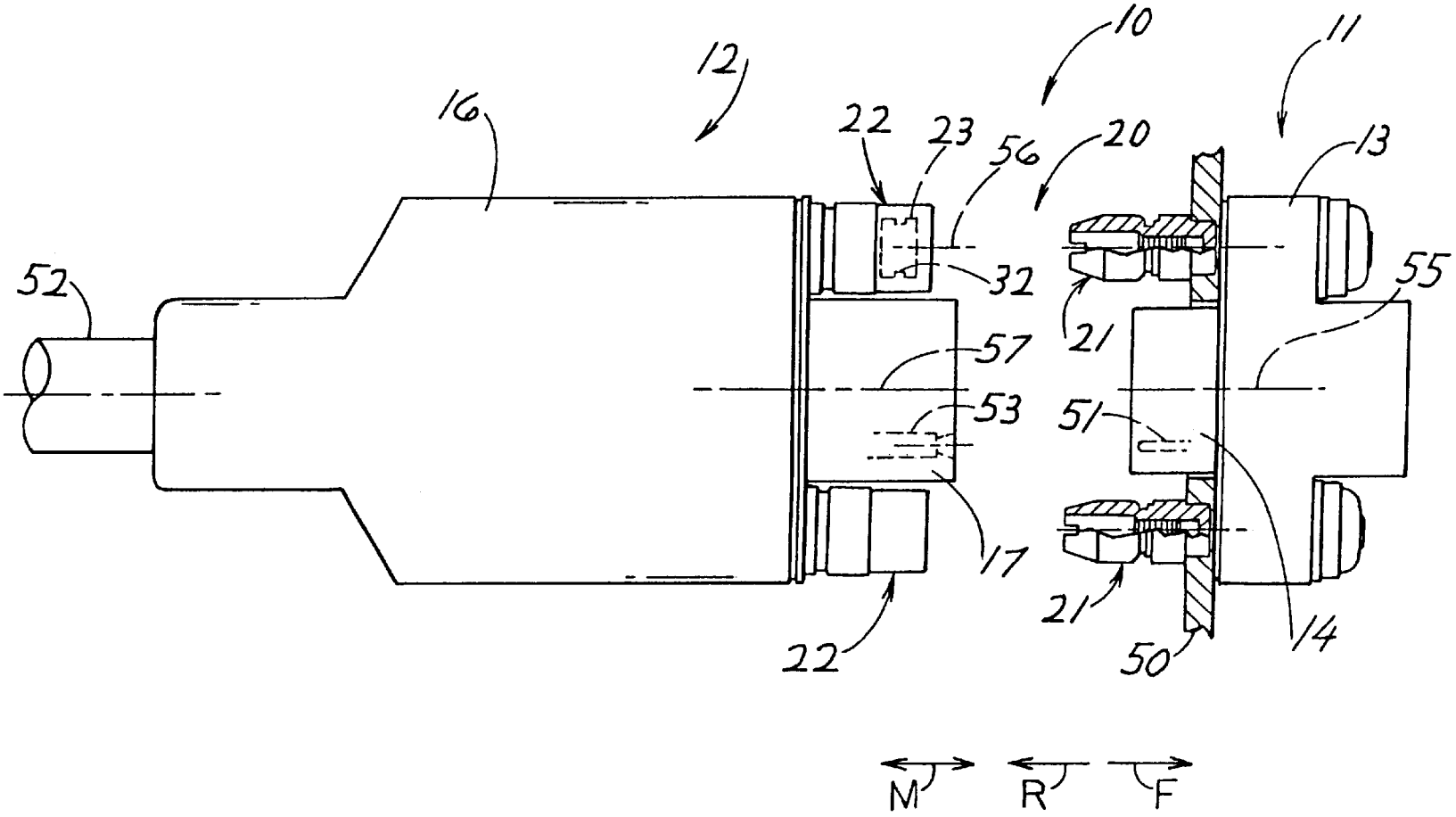
FIG. 1 is a plan view of a pair of connectors that are approaching each other to mate.

FIG. 1 shows a connector system 10 that includes first and second connectors 11, 12 that can mate by moving them together in longitudinal directions M along their connector axes 55, 57. The first connector 11, which is mounted on a circuit board 50, includes a housing 13 for receiving contact wires which are to be connected to the circuit board, and includes a contact assembly 14 with contacts 51 that mate to contacts 53 of a corresponding contact assembly 17 in the second connector. The second connector is designed to connect to a cable 52 with wires that run through a housing 16 and connect to contacts in the contact arrangement 17. When the connectors are mated, they are latched together by a latch assembly 20 which includes studs 21 on the first housing that enter sleeve assemblies 22 on the second housing.

Figure 2:
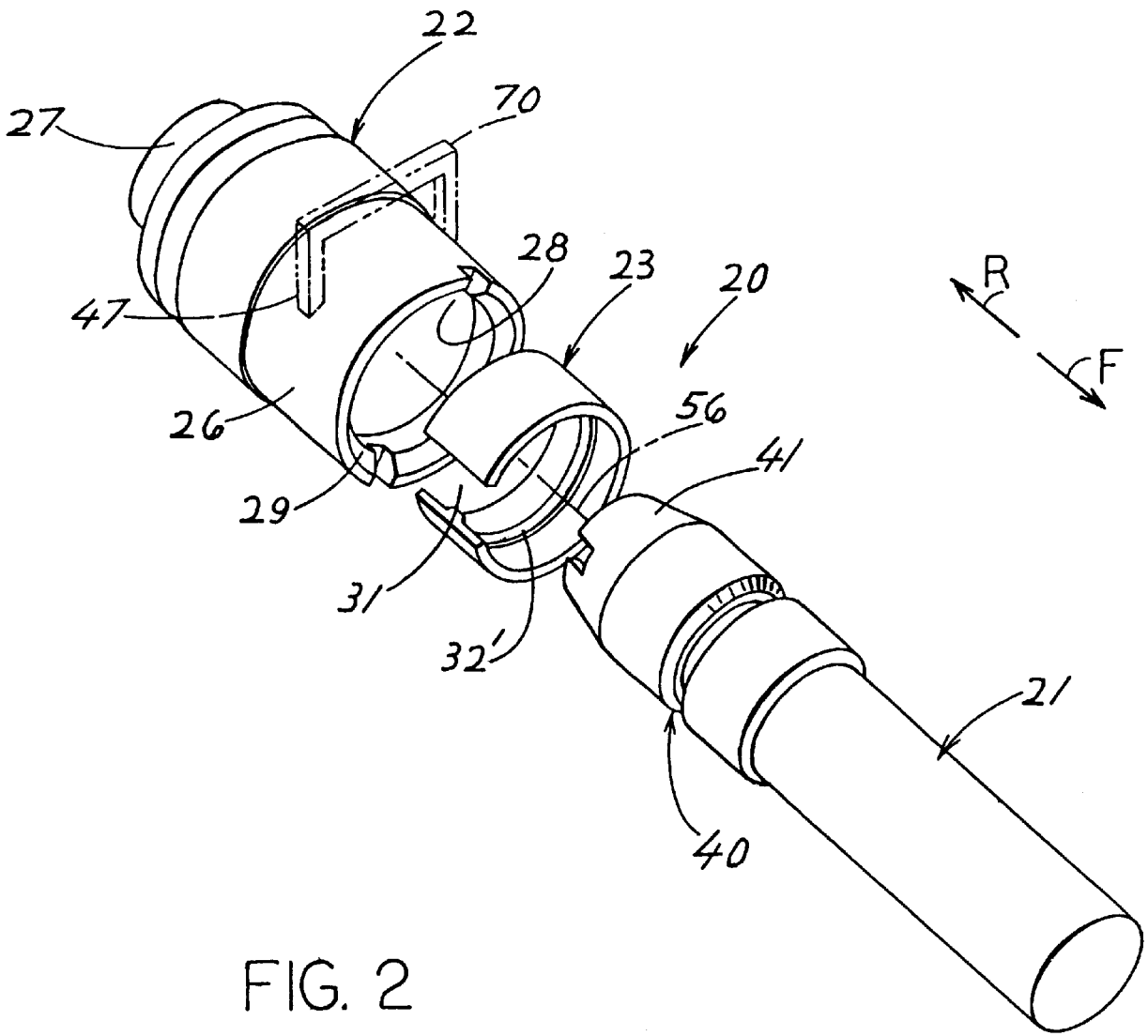
FIG. 2 is an exploded isometric view of a sleeve assembly and stud of the connectors of FIG. 1.
Figure 3:
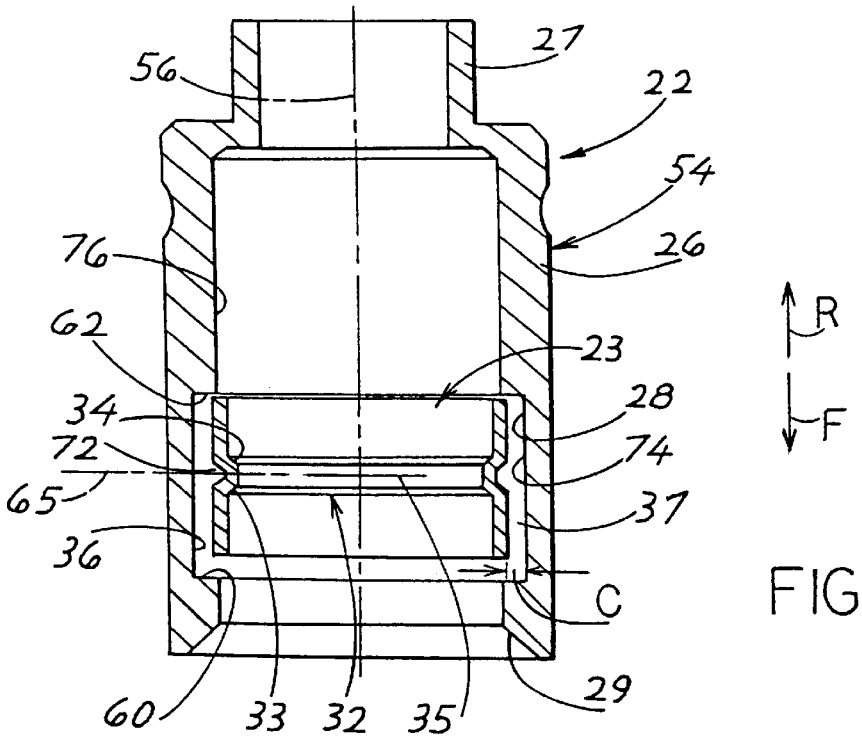
FIG. 3 is a sectional view of the sleeve assembly of FIG. 2.

FIG. 3 shows details of a sleeve assembly 22, which includes an outer sleeve 54 and a spring clip 23. Both the outer sleeve and the spring clip are of generally cylindrical shape, with axes lying on the sleeve assembly axis 56. The outer sleeve has an inside wall forming an internal circumferential sleeve groove 28 with front and rear axially-spaced groove walls 60, 62. The spring clip is trapped in the groove. The outer sleeve has a rear end 27 that is fixed to the rest of the housing. As shown in FIG. 2, the spring clip 23 has a largely axially-extending slot 31 that allows the clip to expand and contract in diameter. In the undeformed configuration of the spring clip shown in FIG. 3, the spring clip is trapped in the groove 23.

The clip has an inwardly-projecting latching portion or internal flange 32 which can snap into a groove 40 in one of the studs 21. The flange has front and rear ends at 33, 34 which are angled from a radial direction (that would be radial to the axis 56). The front end 33 is inclined radially inwardly and rearwardly, while the rear end 34 is angled radially inwardly and forwardly. These inclines of the flange ends help to allow the stud to be pushed into and pulled out of the sleeve assembly although tapers on the stud assure this. It is preferred that the clip be symmetric about a plane 65 that is normal to the axis 56, although the exact distance between the flange 32 and the front and rear ends is not of much importance.

Figure 4:
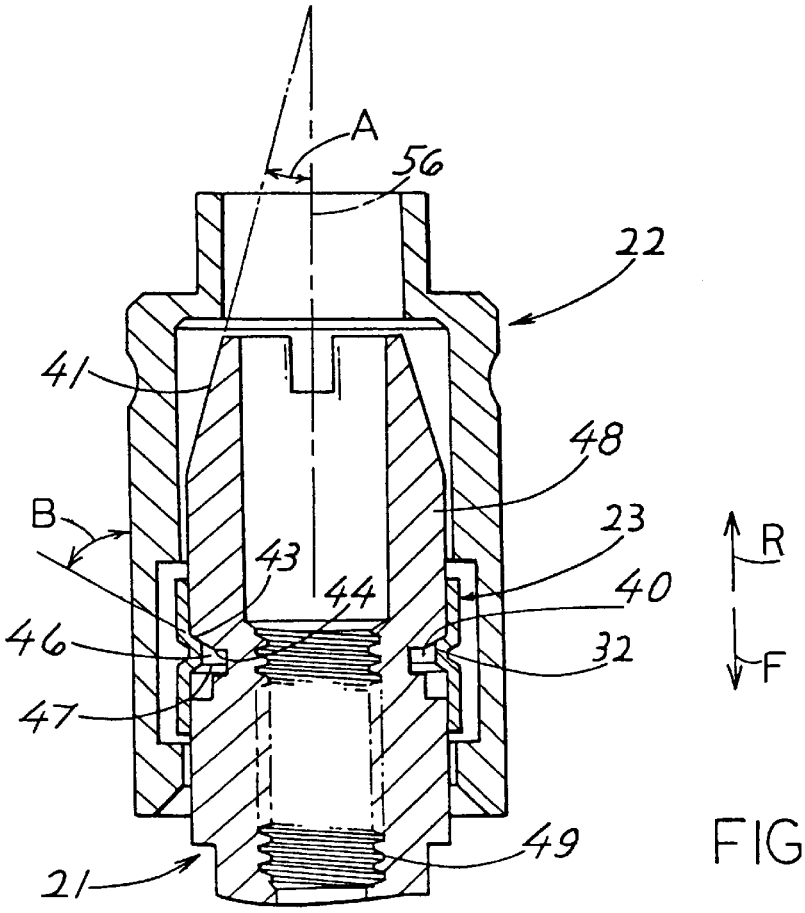
FIG. 4 is a sectional view of the sleeve assembly and stud of FIG. 2 in a fully assembled and latched configuration.

As shown in FIG. 4, the stud 21 has a conical lead-in rear end 44, with the groove 40 spaced a distance forward of the lead-in. When the stud is inserted into the sleeve assembly 22, the tapered rear end 41 expands the spring clip 23 until the flange 32 snaps into the groove 40. Thereafter, the stud is latched to the sleeve assembly, so the connectors are latched together, until the stud and sleeve assembly are forcefully pulled apart.

The groove 40 in the stud has a rear wall 43 that is beveled in a radially inward and forward direction. This helps to remove the stud from the sleeve assembly by the region 43 expanding the spring clip. The groove 40 has a radially inner wall region 44 with a rear wall that faces directly forwardly. This can be used to receive a locking device, shown at 70 in FIG. 2, with one or more posts 47, to positively lock the stud in the sleeve assembly.

The force required for mating the connectors is relatively small because the stud rear end at 41 forms a relatively small angle A with the axis 56, the particular angle A being shown to be 15°0, and preferably being less than 25° for easy insertion of the stud. The angle B of the clip front end 33 and of the stud groove wall 43, is about 60°, which provides considerable resistance to pullout of the stud from the clip. The particular angle B is preferably between 30° and 70°, with resistance varying with the thickness and temper of the sheet metal of the spring clip. In this regard, it may be noted it is possible to form the spring clip as a machine part, as shown in applicant's FIG. 2 where the internal flange 32' is formed by machining. However, applicant prefers to form the spring clip from the formed sheet metal, with the flange 32 shown in FIG. 3 formed as a result of a depression at 72 in the outside of the spring clip.

It is noted that FIG. 3 shows there is a considerable clearance C between the outside of the spring clip and the inside of the cylindrical walls 74 of the outer sleeve groove 28. This clearance is great enough to allow the spring clip to expand as it rides over a portion 48 of the stud that is of greatest diameter and that lies rearward of the spring clip in the fully installed position of FIG. 4. This generally requires a clearance C that is greater than the sheet metal thickness. Even in the undeformed configuration of the spring clip, shown in FIG. 3, the spring clip outside diameter should be greater than the inside diameter of the rear portion 76 of the outer sleeve that lies forward and rearward of its groove, to always retain the spring clip in the groove 28. The front end of the sleeve forms a tapered lead-in 29 to center the inserted stud.

FIG. 2 shows that the slot 31 in the spring clip extends about 40° about the axis 56. The flange 32 shown in FIG. 3, extends around substantially the entire spring clip, except, of course, for the slot. As a result, the flange 32 extends about 320° about the axis 56 to provide secure latching of the stud 21 in the sleeve assembly. It is possible to form the flange 32 at only perhaps three locations around the clip with the flange being interrupted. However, applicant prefers that the flange extend by at least 120° around the axis, or one third of a circle, to securely latch the inserted stud. A flange that extends at least 180° is preferred.

Thus, the invention provides a sleeve and stud latching arrangement for a connector system, which is of simple and easily installed construction. The sleeve assembly includes a sleeve with an internal groove and a spring clip lying in the groove and having an internal flange. The stud has a groove that receives the flange of the spring clip when the stud is fully inserted, to latch the stud in the sleeve assembly. The clip is preferably symmetric about its flange, to allow installation of the spring clip in either of two opposite orientations.

While most connectors would use two studs and two sleeve assemblies, it is possible to use only one of each on the connector axes.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A second connector with at least one sleeve assembly for receiving a grooved stud of a mating first connector to lock the connectors together, wherein:

said sleeve assembly includes a sleeve with an axis and with an internal sleeve groove that has front and rear groove ends and a cylindrical groove wall extending between said ends;

said sleeve assembly includes a spring clip of largely cylindrical shape with radially inner and outer surfaces, said clip being trapped in said sleeve groove, and said clip having a largely axial slit that allows the clip to radially expand and contact, said clip having a projection extending radially inward from said inner surface to form an internal flange to snap into the stud groove;

said sleeve groove having a radially inner side of a length at least as long as said clip, to allow the contracted clip to slide axially within said sleeve until the entire length of said clip snaps into said sleeve groove;

wherein said clip lies loosely in said sleeve groove and can move freely in any direction that is radial to said sleeve axis and against said groove cylindrical walls.

2. A connector system that includes first and second mateable connectors, where the second connector has at least one sleeve assembly that opens along a longitudinally-extending axis in a front direction and the first connector has at least one stud that is insertable into said sleeve as said connectors mate, wherein:

said stud has an outer surface with a stud groove that extends in a circumferential direction around said axis into said outer surface;

said sleeve assembly includes a sleeve with an internal groove that forms cylindrical groove walls, and said sleeve assembly includes a spring clip trapped in said groove, said clip being cylindrical with a slit that allows clip expansion and compression;

said clip having front and rear ends and a radially inwardly projecting latching flange that is resiliently expandable with expansion of said clip, so said stud can be axially inserted into said clip to expand it until said flange snaps into said stud groove;

said clip is free to move radially in any direction against said groove cylindrical walls, and said flange extends in a circumferential band that is spaced at a substantially constant distance from said clip ends.

3. The connector system described in claim 2 wherein:

said clip is formed of a piece of sheet metal with front and rear ends and with a band-like middle portion that forms said band and that has been deformed to form said flange, said band being of substantially constant cross-section as viewed in a sectional view that is taken along said axis, said clip having been rolled into a cylinder that has cylinder sides separated by said slit, said piece of sheet metal being devoid of multiple through slots to provide high holding force.

4. The connector system described in claim 2 wherein:

said flange extends approximately 320° about said axis.

5. A connector system that includes first and second mateable connectors, where the second connector has at least one sleeve assembly that opens along a longitudinally-extending axis in a front direction and the first connector has at least one stud that is insertable into said sleeve as said connectors mate, wherein:

said stud has an outer surface with a stud groove that extends in a circumferential direction around said axis into said outer surface;

said sleeve assembly includes an outer sleeve with an inside wall forming a sleeve inside, said inside walls forming an internal sleeve groove with front and rear groove end walls;

a spring clip in form of a cylinder with a largely axially-extending slot that allows the cylinder to resiliently expand and contract, said sleeve groove having a groove length at a radial inner part of the groove which is sufficient to allow said spring clip to radially expand into said groove after said clip is contracted in diameter and slid along said sleeve inside to said sleeve groove;

said spring clip has front and rear clip ends and lies in said sleeve groove and has an undeformed outside diameter that traps said spring clip between said groove end walls;

said spring clip having a radially inwardly-projecting flange that is of a radius to snap into said stud groove and thereby resist axial movement of said stud.

* * * * *